United States Patent [19]

O'Keefe, Sr.

[11] Patent Number: 4,890,350

[45] Date of Patent: Jan. 2, 1990

[54] EMERGENCY PAINT BRUSH

[76] Inventor: William F. O'Keefe, Sr., 2211 O'Keefe Pl., Zephryhills, Fla. 34248

[21] Appl. No.: 278,798

[22] Filed: Dec. 2, 1988

[51] Int. Cl.[4] ..... A46B 3/00; A46B 3/02

[52] U.S. Cl. ..... 15/176.6; 15/226; 15/145

[58] Field of Search ..... 15/168, 170, 174, 189, 15/204, 225, 226, 223, 224, 227, 246, 230.15, 230.12, 228, 229.2, 145, 229.1

[56] References Cited

U.S. PATENT DOCUMENTS

| | | | |
|---|---|---|---|
| 848,920 | 4/1907 | Pedergrass . | |
| 2,595,776 | 5/1982 | Downey . | |
| 2,810,977 | 10/1957 | Barry . | |
| 2,879,533 | 4/1954 | Ward . | |
| 2,915,767 | 12/1959 | Vaughan | 15/227 X |
| 3,609,789 | 10/1971 | Slatter . | |
| 3,805,313 | 4/1974 | Keating . | |
| 4,550,468 | 11/1985 | Nelson | 15/229 R |

*Primary Examiner*—Peter Feldman

*Attorney, Agent, or Firm*—Joseph C. Mason, Jr.; Ronald E. Smith

[57] ABSTRACT

A brush-bristle carrying device that is attachable to a handle member to form a brush. A thin layer of an adhesive overlies a flexible strip of material and is protected by a flexible protective cover that is peeled away when a brush is to be made. A bundle of bristles are adhered to one another at a first end so that the second end has utility as a brush. The first end of the bundle is adhered to the flexible strip on its adhesvie covered side. To make a brush, the protective cover is peeled from the adhesive covered flexible strip and that strip is wrapped around the end of a handle. The handle is provided by any available material of generally linear configuration.

4 Claims, 1 Drawing Sheet

EMERGENCY PAINT BRUSH

TECHNICAL FIELD

This invention relates, generally, to brushes for applying paint, or for cleaning optical equipment, electrical equipment and the like. More particularly, it relates to a brush having utility in emergency situations where a conventional brush is not available.

BACKGROUND ART

Paint brushes and brushes for other uses are commonly manufactured items. They are manufactured as integral units and include a handle member, a plurality of bristles embedded or otherwise secured to a base member and means for binding the base member to the handle member. In paint brushes, a metal band is commonly used to bind the bristle-carrying base member to a handle.

Moreover, brushes tend to be relatively expensive items, especially if they will be used only once and only for a small job. Even a brush that costs only a few dollars is expensive if it is used once and discarded. Accordingly, there is a need for a disposable brush that would only cost pennies so that it could be used economically even for the smallest of jobs.

U.S. Pat. No. 4,550,468 to Nelson shows a mop construction where a strip of Velcro is secured around a mop handle and a mating strip of Velcro is secured to a mop head to releasably secure the head to the handle. A third strip of Velcro holds the strands of the mop together when they are wrapped around the mop handle.

Another U.S. Pat. No. 2,915,767 to Vaughan, discloses a disposable toothbrush having bristles embedded in a resilient pad and a flexible strip having an under surface coated with a pressure sensitive adhesive layer protected by a removable cover. The removable protective cover overlies the bottom of the pad and the bristles extend radially from the longitudinal axis of a finger around which the flexible strip is wrapped to form the disposable toothbrush.

Other U.S. patents of interest include U.S. Pat. Nos. 3,805,313 to Keating, 3,609,789 to Slaiter, 2,810,977 to Barry, 2,595,776 to Downey, 848,920 to Pederlanss and 2,879,533 to Ward.

DISCLOSURE OF INVENTION

The present invention provides an unassembled brush that is assembled by a consumer only when needed. When assembled, the bristles of the brush collectively extend parallel to the longitudinal axis of symmetry of a handle member that is selected by the consumer from a stock of any available, generally linear in configuration handle members.

An elongate strip of flexible material has a first surface having a thin layer of adhesive applied thereto and a second, reverse surface, that is free of adhesives. A bundle of bristles is collectively secured by an adhesive at the base of each bristle to the first surface, and a flexible protective cover member overlies both the first surface of the flexible strip and the base of the bristles adhered thereto.

To use the apparatus, the consumer must first locate a suitable handle means of generally linear configuration. For example, a pencil or ball point pen may be used. In the absence of a pen or pencil, a generally straight piece of wood or other material may be employed.

Next, the consumer must remove the protective cover; removing the cover exposes the bristle-carrying, adhesive-covered first surface of the flexible strip. The base of the bristles is placed into abutting engagement with a preselected end of the preselected handle means and the flexible strip is wrapped thereabout. The resulting structure simulates a conventionally manufactured brush in that the bristles will be aligned parallel to the longitudinal axis of the handle. This important feature of this invention distinguishes it from the above-mentioned disposable toothbrush where the bristles extend radially with respect to the handle member It is therefore understood that a primary object of this invention is to provide a brush apparatus, for use in emergency situations, that is provided to consumers in unassembled form and which requires the consumer to provide the handle part of the apparatus.

Another object is to make brushes available to consumers that are extremely inexpensive so that they can be used economically for even the smallest of jobs.

The invention accordingly comprises the features of construction, combination of elements and arrangement of parts that will be exemplified in the descriptions set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
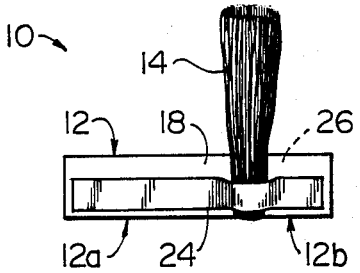
FIG. 1 is a top plan view of the preferred embodiment of the invention before its protective peel and seal strip has been removed.
Figure 2:
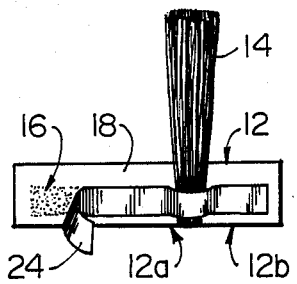
FIG. 2 is a view similar to that of FIG. 1, but showing the peel and seal strip in the process of being removed.

Referring now to the drawings, it will there be seen that an illustrative embodiment of the present invention is designated by the reference numeral 10 as a whole.

Apparatus 10 does not include a handle member as that part of the assembled device is provided by the consumer. The novel apparatus includes elongate flexible strip 12 which is preferably of rectangular configuration as shown, a plurality of bristle members, collectively denoted 14, a thin layer of adhesive 16 that overlies a first surface 18 of strip 12, a thick layer of adhesive 20 that overlies the base part 22 of bristles 14 and adheres said base part to strip 12 and a flexible protective cover member 24 that overlies that part of surface 18 covered by adhesive strip 16. Surface 26 of strip 18 has no adhesive thereon.

It should be noted that the illustrated placement of base 22 of bristles 14 divides strip 12 into elongate part 12*a* and truncate part 12*b*, both of which are fully covered with a thin layer of adhesive 16 or partially covered as shown.

The longitudinal extent of truncate part 12*b* is substantially equal to the longitudinal extent of the base 22 of bristles 14 as shown.

Figure 3:
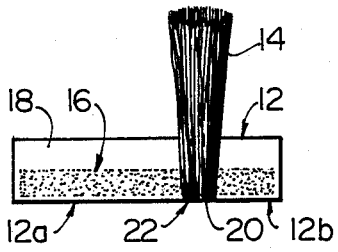
FIG. 3 is a top plan view of the preferred embodiment with the protective strip having been removed.
Figure 4:
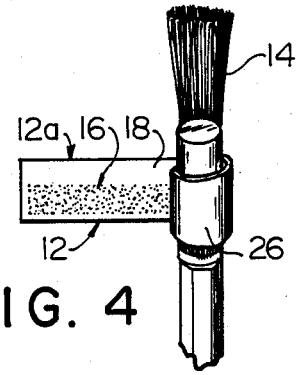
FIG. 4 is a view that shows how the invention is secured to a suitable handle means.

To use apparatus 10, a suitable handle member such as pencil 28 is selected and protective cover 24 is pealed from its releasable engagement with adhesive 16. A preselected end of pencil 28 is then placed into overlying relation to base 22 of bristles 14; truncate part 12*b* of strip 12 is folded over (from right to left in FIG. 3) so that it overlies the preselected end of pencil 28 as shown in FIG. 4 and elongate part 12*a* of strip 12 is then wrapped around so that it overlies truncate part 12*b*. The length of elongate part 12*a* is sufficient to allow it to wrap around itself at least once to tightly secure bristles 14 to handle 28 as shown in FIG. 5.

Figure 5:
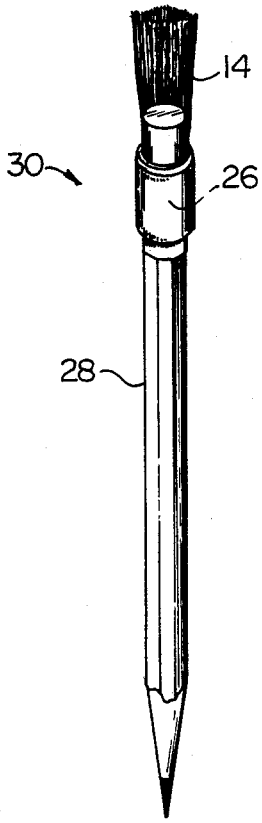
FIG. 5 is a fully assembled view of a preferred embodiment of the inventive apparatus.

The fully assembled brush is shown in FIG. 5 and is denoted 30 as a whole. The bristles 14 are slightly offset from the longitudinal axis of symmetry of handle 28, and are longitudinally aligned therewith, thereby closely simulating a manufactured brush.

Whether the assembled device is used for cleaning electrical equipment or as a paint brush or other use, its minimal cost enables it to be used once and discarded. Handle 28 is not discarded and can be reused. This is in sharp contrast to conventional brushes because their handles must be discarded with the bristles.

Figure 6:
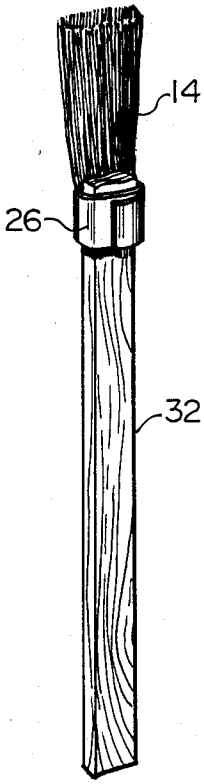
FIG. 6 is a perspective view of an alternative assembled embodiment of the invention.

FIG. 6 shows an alternative embodiment of the invention where a piece of wood 32 is used instead of a pencil 28.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An article of manufacture, comprising:

a first elongate strip of flexible material;

a first layer of adhesive disposed in overlying relation to a first surface of said flexible material;

a plurality of bristle members disposed in abutting parallel alignment with one another;

said plurality of bristle members being adhered to one another at a first end thereof;

said first end of said bristle members being disposed in overlying relation to said first surface of said material at a predetermined position along the extent thereof; and said plurality of bristle members being aligned normal to a longitudinal axis of said strip of flexible material, and being disposed substantially parallel to the plane of said strip of flexible material;

whereby a brush is made by selecting a handle means, positioning a preselected end of said handle means in overlying relation to said first end of said plurality of bristle members, and wrapping said flexible material about said handle means.

2. The article of claim 1, further comprising a flexible protective cover releasably secured to said first surface of said flexible material.

3. The article of claim 2, wherein the predetermined position is offset from the center of said elongate strip of flexible material.

4. The article of claim 3, further comprising a second layer of adhesive joining said first end of said plurality of bristle members to said first surface of said flexible material.

* * * * *